United States Patent [19]

Huqueriza

[11] 4,302,017

[45] Nov. 24, 1981

[54] BALL THROWING AND CATCHING DEVICE

[76] Inventor: Cesar S. Huqueriza, 658 Moana Way, Pacifica, Calif. 94044

[21] Appl. No.: 144,235

[22] Filed: Apr. 28, 1980

[51] Int. Cl.[3] ..... A63B 65/12

[52] U.S. Cl. ..... 273/323

[58] Field of Search ..... 273/317, 318, 326, 327, 273/322, 328

[56] References Cited

U.S. PATENT DOCUMENTS

| | | | |
|---|---|---|---|
| 734,752 | 7/1903 | Ring | 273/323 |
| 1,570,632 | 1/1926 | Kideney | 273/323 |
| 2,436,174 | 2/1948 | Myers | 273/327 |
| 3,115,129 | 12/1963 | Merriman | 273/323 X |
| 3,392,978 | 7/1968 | Wiest, Jr. | 273/322 |
| 3,671,040 | 6/1972 | Meyer et al. | 273/326 |
| 3,697,074 | 10/1972 | Duncan | 273/326 |
| 3,887,184 | 6/1975 | Cavaliere | 273/328 |
| 4,098,508 | 7/1978 | Gandy | 273/326 |

FOREIGN PATENT DOCUMENTS

| | | | |
|---|---|---|---|
| 339911 | 7/1921 | Fed. Rep. of Germany | 273/322 |

*Primary Examiner*—William H. Grieb
*Attorney, Agent, or Firm*—T. R. Zegree

[57] ABSTRACT

A device for playing a ball game by hurling a ball against a wall and catching it on the rebound is described. The device comprises a hollow, cylindrical, elongated body member having an open end, a closed end and an opening having a partially arcuate configuration extending through a major portion of the body member. The inner surface of the body member defines a passageway for the ball when it is either thrown or caught by the device.

10 Claims, 6 Drawing Figures

BALL THROWING AND CATCHING DEVICE

BACKGROUND OF THE INVENTION

The present invention relates generally to a ball game utilizing a ball-handling device held by hand of a player. More particularly, the invention relates to an amusement device which is adapted for hurling and catching a ball by relatively unskilled or skilled persons manipulating the device.

Various types of devices for throwing and catching a ball have been described in patent literature. One of such devices is shown in U.S. Pat. No. 3,392,978 wherein a ball is launched upwardly on a curved trajectory into the air by the device having an arcuate channel, the device including the tossing opening at one end and the receiving oval inlet at the other end with a handle affixed to the rear side of the device. U.S. Pat. No. 3,115,129 discloses a ball-throwing device comprising a cylindrical main body portion in combination with a hollow handle portion having a fixedly secured core therein. The inside of the main body portion is provided with projecting ribs which are adapted to cooperate with a ball having concentric grooves. U.S. Pat. No. 3,697,074 describes a large bowl-shaped ball launcher having a concave surface and a handle to be held by a player. A ball having very little bounce is thrown upwardly in the air and caught on the down slope of the launcher. U.S. Pat. No. 3,887,184 discloses a hand-held catch ball device having a support, a ball-launching ramp having side rails, a bucket-like receptacle positioned at one end and a handle attached to the opposite end of the device. Other devices employed to hurl a ball against a wall by one player and catch it by the opponent in the game known as Jai-Alai are likewise known in the art. Such devices are of curved configuration and include a handle with a strap means connected to the handle for securing a hand of a player to the body of the device.

The present invention is directed to an improved ball-handling device of the general type of devices discussed hereinabove but is considered to present novel and distinct features not heretofore known in the art.

OBJECTS OF THE INVENTION

Accordingly, it is the main object of this invention to provide a ball game device which offers a substantial improvement upon the prior art devices due to its simple construction and ease of handling thereof.

Another object of the invention is to provide a ball hurling and catching device which can be utilized in playing a ball game on a conventional racquetball or handball court.

Still another object of the invention is to provide a device for throwing and receiving a bouncing ball, such device having a sole opening therein and being adapted to be hand-held without separate handle combined therewith.

An even further object of the invention is the provision of a ball-handling device useful for physical exercise or entertainment which can be manufactured at a low cost from readily available materials.

These and other objects of this invention will become more fully apparent from the following description taken in conjunction with the accompanying drawing.

BRIEF SUMMARY OF THE INVENTION

In accordance with the preferred embodiment of the present invention a ball game device for hurling and catching a ball comprises a hollow, upright, relatively rigid, substantially cylindrical body member having an open end, a closed end wall and a side wall, said side wall having an upper portion terminating in form of an arcuate lateral edge and a lower portion adjacent said end wall, the outer surface of said lower portion of said side wall defining a hand-holding area of said device. The body member has an elongated opening in the side wall, the opening extending lengthwise over a major portion of the side wall from its arcuate edge to the upper edge of said hand-holding area. The inner surface of the side wall defines a rolling passageway for the ball when it is either hurled or caught in the device by a player.

BRIEF DESCRIPTION OF THE DRAWING

The invention will now be more fully described with reference to the accompanying drawing wherein.

DETAILED DESCRIPTION

Figure 1:
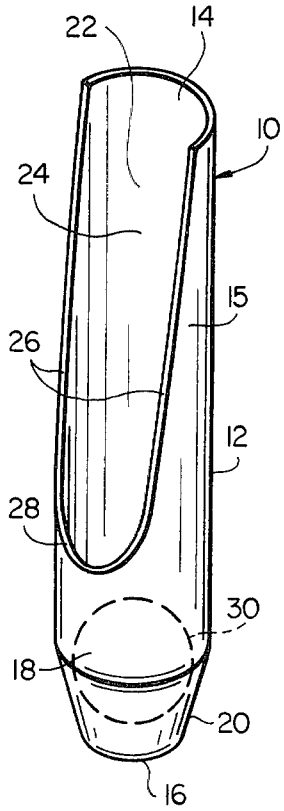
FIG. 1 is a perspective view of the device showing a ball placed in the interior thereof on its end wall.
Figure 2:
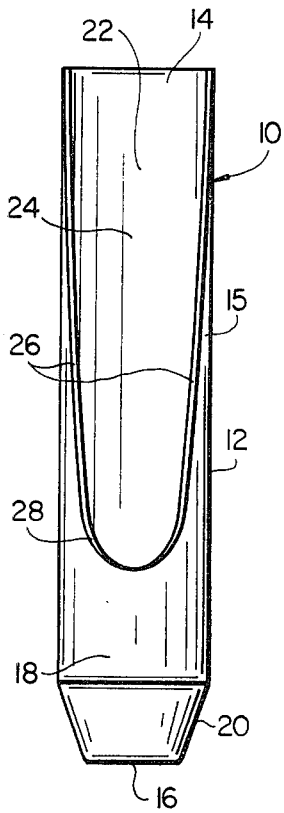
FIG. 2 is a front elevational view of the device.
Figure 3:
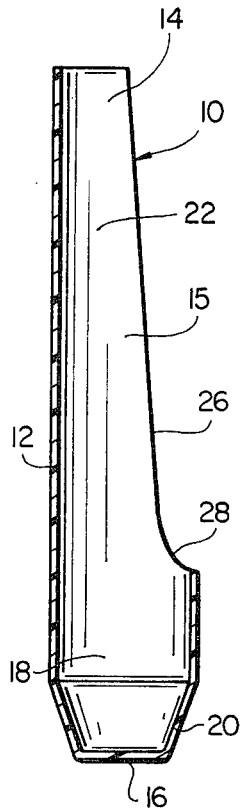
FIG. 3 is a side elevation cross-sectional view of the device.

Referring now to FIGS. 1–3 of the drawing, wherein similar reference characters designate corresponding elements, the ball game device 10 of this invention is illustrated by three views in its upright position. The device 10 comprises an integral, upright, cylindrically shaped body member 12 having an open end 14, a straight side wall 15 and a circular end wall 16. The outer surface of the lower portion of side wall 15 constitutes a hand-holding area 18 for a player thereby obviating the necessity of having a separate handle affixed to the device as shown in the prior art. The end portion 20 of the lower end of side wall 15 is progressively tapered in the direction of end wall 16 to adapt the inner surface of end wall 16 to a diameter corresponding approximately to the diameter of a ball 30 utilized in conjunction with device 10, thereby preventing excessive lateral movement of the ball when placed on the bottom of device 10 in position to be projected therefrom. As illustrated, end wall 16 is flat and its diameter is adapted to be substantially equal to the diameter of ball 30.

The inner surface 22 of device 10 is smooth and its cylindrical rear area defines a straight line passageway for the ball 30 when it is either hurled or received in device 10. Side wall 15 is provided with an elongated opening 24 in the front portion of body member 12 and comprises two downwardly extending symmetrical sloping edges 26 which have a partially arcuate configuration 28 merging into the upper edge of the hand-holding area 18. The opening 24 extends lengthwise of the body member 12 over the major portion thereof from the arcuate edge of the upper portion of side wall 15 to the upper edge of the hand-holding area 18 in the front of body member 12.

The boundary of open end 14 is defined by a continuously arcuate edge of the upper portion of side wall 15, the circumferential length of which is equal to about one-half of the diameter of the cylindrical body member 12 in the hand-holding area 18, while the length of hand-holding area 18 between its lower edge adjacent the end wall 16 and its upper edge is slightly greater than the diameter of ball 30 to insure that the ball will be prevented from unintentional displacing or falling out from device 10 when held in upright or even tilted to almost horizontal position.

To appreciate the dimensions of device 10, the overall length of body member 12 may vary from about 6 in. (15.2 cm.) to about 15 in. (38.1 cm.), the preferred length being about 12 in. (30.5 cm.), its diameter at the hand-holding area level may vary from about 2 in. (5.1 cm.) to about 4 in. (10.2 cm.), respectively, the preferred diameter being about 2.5 in. (6.3 cm.). For best results in operating the device 10 for throwing and catching a ball, the overall length of body member 12 should be from about 3 to about 6 times greater than the diameter of ball 30. As regards the inner diameter of the circular lower portion of body member 12 in the hand-holding area 18, it should be from about ¼ in. (0.64 cm.) to about 1 in. (2.54 cm.) greater than the diameter of the ball 30 used with device 10 to insure that there is sufficient clearance for a free passage of the ball in the interior of the hand-holding area 18 without any hindrance.

Figure 4:
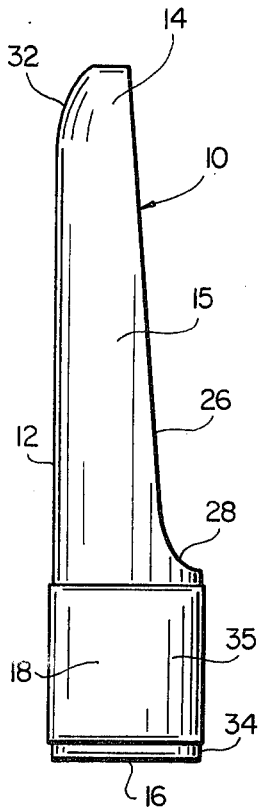
FIG. 4 is a side elevational view of an alternate embodiment of the invention showing curved upper portion of the side wall.

In an alternate embodiment of the invention, as shown in FIG. 4, the upper portion of side wall 15 is slightly curved upwardly and inwardly to form a tapered open end 32 of device 10. It has been found that the effectiveness of device 10 having a tapered open end 32 is enhanced particularly when a ball is launched or caught at a high speed. Moreover, the lower end portion 34 of device 10 is straight forming a right angle with end wall 16 thus making its diameter equal to that of body member 12. Device 10 having such configuration in its lower portion has increased stability when placed on a flat surface in its upright position. It is to be noted that the configuration of device 10 shown in FIG. 1 may be modified by providing it with a straight end portion 34 and/or a tapered open end 32.

To insure a firm manual grip of the hand-held area 18, it may be overlaid with a relatively thin band of a suitable non-slippery material 35, such as a fabric, canvas, rubber, leather or the like. Such material may be secured adhesively or by any other suitable means to the outer surface of the hand-holding area 18.

To increase somewhat the friction between ball 30 and smooth passageway inside device 10, the inner surface of body member 12 may also be covered with any suitable non-slippery fabric material thereby improving the spin of ball 30 and decreasing its slippage especially during its launching.

While device 10 is preferably constructed of a substantially rigid, lightweight, durable molded plastic, other materials, such as wood, fiberboard, metal or combinations thereof are likewise suitable. The wall thickness of device 10 should be sufficient to insure its adequate structural strength and durability.

The ball 30 used in conjunction with device 10 should possess a good bounce to be able to spring back from a wall after it is thrown against it. A conventional all-purpose rubber handball is entirely satisfactory.

Figure 5:
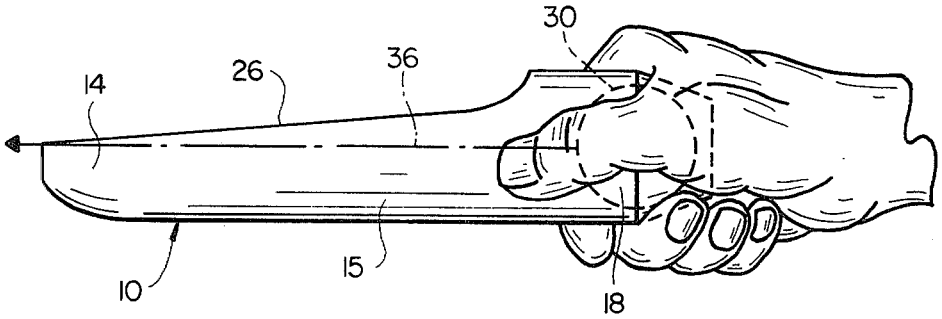
FIG. 5 is a pictorial view of the device held in the player's hand in the position for hurling a ball.
Figure 6:
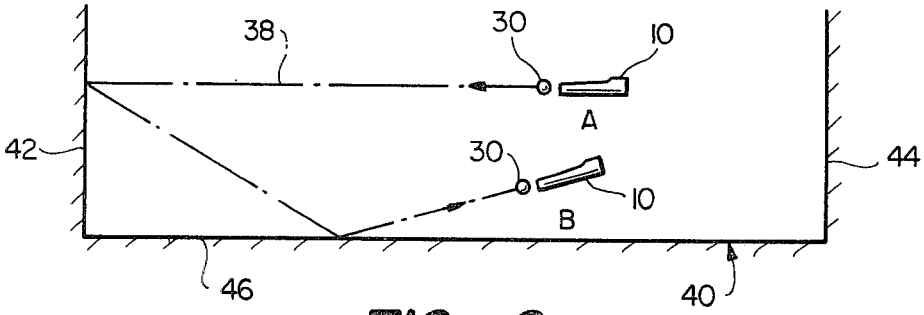
FIG. 6 is a diagrammatic view of a court and of a manner of playing the ball game by two persons.

The manner of handling the device of this invention can best be understood from consideration of the views shown in FIGS. 5 and 6. Ball 30 is first positioned inside the device 10 adjacent its end wall 16. Device 10 is held by player's hand in a substantially horizontal position but slightly inclined upwardly and forwardly to prevent the ball from rolling but inadvertently. The ball is ejected from the device toward wall 42 by a rapid swinging type motion of player's arm by traversing the length of the passageway of device 10 along the trajectory 36 indicated in FIG. 5 by dotted line in the direction of the arrow.

FIG. 6 illustrates diagrammatically a court 40, such as a standard handball court, having two opposite walls 42, 44 and floor 46. The game is played by two players, designated by letters A and B, standing side by side, each player holding a device 10. Player A hurls ball 30 against wall 42 along the trajectory 38. On the rebound of the wall 42 the ball bounces on floor 46 and is caught by device 10 held by player B who, in turn, hurls the ball against wall 44 to make it rebound and caught in the same manner by player A. The game continues until one of the players fails to catch the ball in the device. It will be understood that the game may be played according to any other predetermined rules by 2, 3 or 4 persons. Likewise, one person can utilize the device 10 with ball 30 for practice purposes.

Using the device of this invention, it is relatively easy for an unskilled person to throw a ball against a desired area of a wall. While catching the ball requires some skill and dexterity, it may be learned in a relatively short period of time depending on the ability and coordination of the individual.

It will be apparent from the foregoing description that I have devised an improved means for throwing and catching a ball, the means being characterized by a number of novel features. Due to simplicity of its construction, the device of the present invention may be manufactured readily and inexpensively in large volume. It will be understood that various modifications in the form or in the constructional details of this invention as herein described may be made without departing from the spirit thereof or the scope of the claims which follow.

I claim:

1. A ball game device for hurling and catching a ball comprising a hollow, upright, relatively rigid, substantially cylindrical body member having an open end, a closed end wall, a side wall, said side wall having an upper portion terminating in the form of an arcuate edge and a lower portion adjacent said end wall, the front portion of said side wall comprising two downwardly extending symmetrical slopping edges, the outer surface of said lower portion of said side wall defining a hand-holding area of said device, said body member having an elongated opening in said side wall, said opening extending lengthwise over a major portion of said side wall from said arcuate edge of the upper portion of said side wall to the upper edge of said hand-holding area, wherein the inner surface of said side wall defines a rolling passageway for said ball in said device.

2. The device of claim 1 wherein the lower portion of said side wall is progressively tapered in the direction of said end wall.

3. The device of claim 2 wherein said end wall is flat and its diameter is substantially equal to the diameter of said ball.

4. The device of claim 1 wherein the upper portion of said side wall is curved upwardly and inwardly to form a tapered open end thereof.

5. The device of claim 1 wherein downwardly sloping edges of said body member have a partially arcuate configuration merging into said upper edge of said hand-holding area.

6. The device of claim 1 wherein the inner diameter of the cylindrical lower portion of said body member is from about ¼ inch (0.64 cm.) to about 1 inch (2.54 cm.) greater than the diameter of said ball.

7. The device of claim 1 wherein the length of said hand-holding area is slightly greater than the diameter of said ball.

8. The device of claim 1 wherein the length of the arcuate edge of said upper portion is equal to about ½ of the diameter of said cylindrical body member.

9. The device of claim 1 wherein the overall length of said body member is from about three to about six times greater than the diameter of said ball.

10. The device of claim 1 wherein the hand-holding area of said device is overlaid with a non-slippery material.

* * * * *